United States Patent [19]

Enomoto et al.

[11] 4,371,429

[45] Feb. 1, 1983

[54] TIMEPIECE HAND MANUFACTURING METHOD

[75] Inventors: Tadao Enomoto; Hidefumi Kasai, both of Tanashi, Japan

[73] Assignee: Citizen Watch Company Limited, Tokyo, Japan

[21] Appl. No.: 294,112

[22] Filed: Aug. 19, 1981

[30] Foreign Application Priority Data

Aug. 25, 1980 [JP] Japan ..... 55-116720

[51] Int. Cl.[3] ..... C25D 1/20

[52] U.S. Cl. ..... 204/4

[58] Field of Search ..... 204/4, 6, 8, 9

[56] References Cited

U.S. PATENT DOCUMENTS 1,570,634 1/1926 Taukel ..... 204/4

3,853,714 12/1974 Shimodo ..... 204/4

*Primary Examiner*—T. Tufariello

*Attorney, Agent, or Firm*—Jordan and Hamburg

[57] ABSTRACT

A method of manufacturing a timepiece hand is disclosed, whereby the hand can be made extremely thin and lightweight, as well as strong and rigid. The timepiece hand is in the form of an open shell formed of hard nickel electro-forming. Because a minimum of mechanical working is performed upon the hand during the manufacturing process, bending distortion of the hand is avoided, and such a hand can be made substantially thinner than has been possible with manufacturing methods of the prior art.

5 Claims, 30 Drawing Figures

TIMEPIECE HAND MANUFACTURING METHOD

BACKGROUND OF THE INVENTION

In recent years, there has been an increasing trend towards making timepieces of thinner and more attractive shape. This is particularly true in the case of timepieces of the so-called analog type, i.e. using time indicating hands. However one difficulty which has been encountered in producing such timepieces has been that of manufacturing timepiece hands which are very thin, yet which should also be strong and rigid, accurately shaped, and which can be firmly attached to the hands driving shafts of the timepiece.

One method which has been used in the prior art to produce timepiece hands of small size has been to press-cut, i.e. to stamp out the hands from a sheet of metal, and then to form the upper face of the hands into a desired shape by machining with a diamond tipped cutting tool. However this method of manufacturing has several disadvantages in the case of timepiece hands of very thin shape. One of these disadvantages is that, as a result of the machining with a diamond tipped cutting tool, bending distortion of the hand will be caused, and the amount of this distortion will increase as the thickness of the hand is reduced. Another disadvantage of this manufacturing method is that, since the thickness of the boss of the hand cannot be very much greater than that of the rest of the hand (i.e. than the thickness of the sheet metal from which the hands were stamped), it is difficult to obtain a sufficient degree of attachment force between the hand shaft of the timepiece and the bore in the boss of the timepiece hand. This problem becomes increasingly severe as the thickness of the timepiece hand is reduced.

Another method used to produce small size timepiece hands is the electro-forming manufacturing method. With this method, electro-forming of a number of layers of different metals is performed on a suitable matrix, with the shape of a portion of the matrix determining the size and shape of the final timepiece hand. However, as will be described later with reference to one of the drawings, it is necessary to perform grinding work upon the matrix in this case, in order to uncover the bore of the timepiece hand boss, before removal of the timepiece hand from the electro-forming matrix. During this grinding work, stresses are introduced into the multiple layers of metal of the timepiece hand, which will result in bending distortion of the hand when it is removed from the matrix. The amount of this bending distortion increases as the thickness of the hand is reduced. In addition, a considerable length of time and a complex electro-forming process are required to form the various metal layers which constitute the timepiece hand, making the manufacturing production costs very high. Thus, such a prior art type of electro-forming process is only used for hands to be provided in very high quality timepieces.

The present invention proposes a method of manufacturing very thin and small timepiece hands, by an electro-forming process, whereby the completed hand is in the form of an open shell of hard nickel electro-forming which is extremely strong and light in weight, and whereby bending distortion of the completed hand is completely eliminated, even when the hand is made of very thin shape. With this method, the electro-forming process can be completed in a small fraction of the time required by a prior art method, and the completed timepiece hands can be rapidly and easily removed from the electro-forming matrix. The method therefore enables timepiece hands of very thin shape to be produced at a low level of manufacturing cost, so that the applications of such hands are not restricted to very expensive timepieces.

BRIEF DESCRIPTION OF THE INVENTION

The present invention comprises an improved method of manufacturing a timepiece hand which can be extremely thin, by an electro-forming process. The completed hand produced by the method of the present invention is in the general form of a thin curved shell consisting mainly of hard nickel. It is a particular feature of the method of the present invention that, when forming a plastic matrix to be used in the electro-forming process, a concave region is formed in the plastic matrix, this concave region being shaped to the desired conformation of the upper face of the timepiece hand, and that this concave region is surrounded by a peripheral convex portion, or ridge, formed in the plastic matrix. It is another particular feature of the present invention that, after a primary layer of an electrically conductive material has been formed over these convex and concave portions of the plastic matrix, the uppermost surface of the convex portion, together with the uppermost face of a protruding portion of the plastic matrix which defines the bore of the boss of the completed timepiece hand, is removed by a primary grinding process, before electro-forming of the layer of hard nickel constituting the main structural component of the timepiece hand is performed. Because of this primary grinding work, mechanical working of the hard nickel layer of the timepiece hand performed after electro-forming of the nickel layer can be substantially reduced, so that bending distortion of the completed timepiece hand due to residual stresses from mechanical working of the metal is almost completely eliminated. In addition, since the layer of hard nickel constituting the main component of the timepiece hand is itself extremely thin (this is possible because of the curved shell shape of the hand), the time required to perform electro-forming is extremely short, so that the cost of manufacture is considerably reduced. Yet another advantage of the method of the present invention is that, since areas of the plastic matrix surrounding the hand are removed during the primary grinding process, the completed hand can be removed from the plastic matrix simply by inverting the plastic matrix and immersing the concave portions thereof in a suitable organic solvent. This solvent will rapidly separate the completed hand from the plastic matrix, with a minimum of solvent being utilized in order to perform the separation, and with no mechanical force being applied to the timepiece hand during the separation process, since the completed timepiece hand will simply drop to the bottom of the solvent container. Ultrasonic cleaning of the completed hand can then be performed while it is still in the organic solvent.

It can thus be seen that the manufacturing method of the present invention enables a thin, strong and lightweight timepiece hand to be produced in an economical as well as a simple and rapid manner, which is highly suited to mass-production manufacture with low production costs.

DESCRIPTION OF THE PREFERRED EMBODIMENTS

Figure 1:
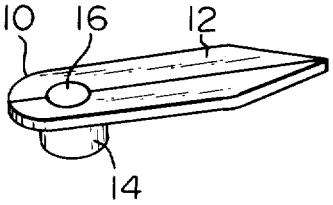
Fig. 1 PRIOR ART
FIG. 1 is an oblique view of a completed timepiece hand produced by a prior art manufacturing method.
Figure 2:
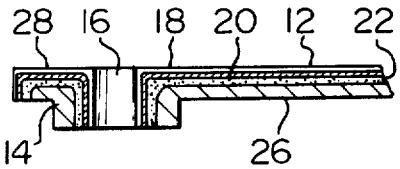
Fig. 2 PRIOR ART
FIG. 2 is a cross-sectional diagram of a timepiece hand produced by an electro-forming method of the prior art.
Figure 3:
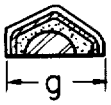
Fig. 3 PRIOR ART
FIG. 3 is another cross-sectional diagram of the timepiece hand of FIG. 2, taken in the direction of the width.
Figure 4:
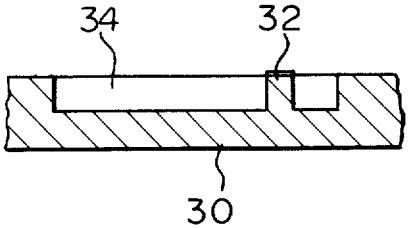
Fig. 4 PRIOR ART
FIG. 4 is a cross-sectional diagram of an electro-forming matrix used in a prior art manufacturing process.
Figure 5:
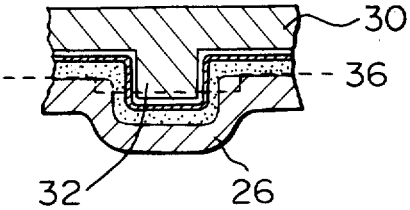
Fig. 5 PRIOR ART
FIG. 5 is an enlarged partial cross-sectional diagram of a boss portion of a timepiece hand formed by electro-forming on the matrix of FIG. 4, illustrating a grinding process.
Figure 6:
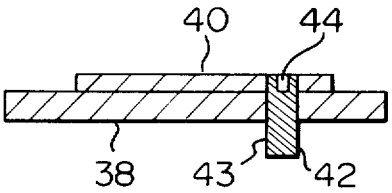
Fig. 6 PRIOR ART
FIG. 6 is a cross-sectional diagram of a mold used in producing the electro-forming matrix of FIG. 4 and FIG. 5.

Referring now to the drawings, FIG. 1 is an oblique view to illustrate the appearance of a timepiece hand manufactured by a method of the prior art. The timepiece hand 10 comprises a main hand portion 12 (i.e. the major longitudinal portion of the hand), and a boss 14 having a bore 16 formed therein. Such a hand is attached to a hand shaft of the timepiece at the time of assembly of the timepiece, by press-fitting the boss onto the hand shaft. FIG. 2 is a cross-sectional diagram through the timepiece hand of FIG. 1, taken in the longitudinal direction, for the case of a timepiece hand manufactured by a prior art electro-forming process. Numeral 18 denotes a layer of electrical conductive material which is formed by a non-electrical process such as evaporative deposition. Numeral 20 denotes a layer of nickel formed by electro-plating, having a thickness of the order of 10 microns, which serves to prevent abrasion of the inner face of the timepiece hand boss bore when the hand is press-fitted onto the hand shaft of the timepiece module. Numeral 22 denotes a layer of crystalline copper pyrophosphate, which is formed by electro-forming, and serves to provide improved attachment between the boss of the timepiece hand and the hand shaft of the timepiece. Numeral 26 denotes a layer of copper sulphate electro-forming, while numeral 28 denotes a finishing plating layer. FIG. 3 is a cross-sectional diagram of the main hand portion of the timepiece hand of FIG. 2, taken in the direction of the width, for the case in which the upper face of the timepiece hand has been machined to the contour shown. The width of the machined hand is denoted as g. FIG. 4 is a cross-sectional diagram of a plastic matrix, denoted by numeral 30, which is used to form a hand such as that of FIG. 2 by an electro-forming method of the prior art. Numeral 34 denotes a longitudinal portion of plastic matrix 30, in which the main hand portion is formed. Numeral 32 denotes a tubular portion whose shape determines that of boss 14 of the hand. The appearance of the boss portion of the hand after electro-forming has been completed is shown in FIG. 5, in expanded partial cross-sectional view. Numeral 36 denotes a grinding contour line, which indicates how grinding work is performed upon the electro-forming layers and boss portion of plastic matrix 30, so as to uncover the bore of the boss. FIG. 6 is a cross-sectional diagram of a part of a mold used to form the plastic matrix 30. Numeral 38 denotes a mold base portion, numeral 40 a part of the mold corresponding to the main hand portion of the plastic matrix, and numeral 42 denotes a boss pin. Boss pin 42 is provided with a cylindrical recess 44, which determines the size of the boss bore portion 32 of plastic matrix 30. The protruding lower portion of boss pin 42, denoted by numeral 43, is used to position the mold in a baseplate.

Formation of a timepiece hand by the process illustrated in FIG. 2 to FIG. 6 has various disadvantages. As can be seen from the cross-sectional diagram of FIG. 3, the main hand portion has a solid cross-section, composed of a number of metallic layers, of a substantial thickness. Thus, a large amount of time is required to complete the electro-forming process to manufacture such a hand. In addition, when grinding operations are performed on the electro-formed layers, as shown in FIG. 5, stresses are left in the various layers forming the hand, due to mechanical deformation of these layers occurring during the grinding process. As a result, bending deformation of the completed timepiece hand will occur when the hand is removed from plastic matrix 30. Such bending distortion is illustrated in the simplified cross-sectional diagram of FIG. 7. Here, the amplitude of bending distortion of a timepiece hand having a total thickness f is designated as e. The size of the bending distortion e will increase as the thickness f is reduced, for a prior art electro-forming process such as that described above. It is therefore not practicable to produce a timepiece hand having a thickness of the order of less than 200 microns by such a prior art electro-forming method.

Figure 8:
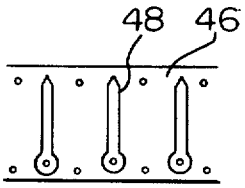
Fig. 8 PRIOR ART
FIG. 8 is a view in plan of a metal sheet having a number of timepiece hand portions cut out therefrom by a press-cutting process.
Figure 9:
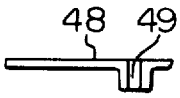
Fig. 9 PRIOR ART
FIG. 9 is a cross-sectional diagram of a timepiece produced by the press-cutting method.
Figure 10:
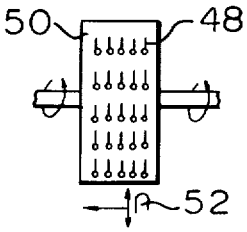
Fig. 10 PRIOR ART
FIG. 10 is a diagram illustrating a method of shaping a number of timepiece hands formed by the press-cutting method, by utilizing a diamond tipped cutting tool.
Figure 11:
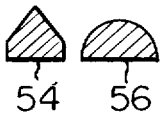
Fig. 11 PRIOR ART
FIG. 11 is a cross-sectional diagram showing timepiece hand shapes which may be produced by the method illustrated in FIG. 10.

FIG. 8 is a diagram to illustrate another prior art method of manufacturing a timepiece hand, by a press-cutting process. In this case, a number of hand blanks denoted by numeral 48 are press-cut from a sheet of metal 46. The shape of the resultant hand blank 48 is shown in the cross-sectional diagram of FIG. 9. It will be apparent that it is difficult with such a press-cutting method to precisely determine the shape of the boss of such a timepiece hand, so that problems arise with respect to attachment of the finished hand to the timepiece hand shaft. These problems become increasingly severe as the thickness of the hand is reduced. Such a hand blank is generally then shaped using a diamond-tipped cutting tool. Such a shaping process is illustrated in FIG. 10, in which a number of hand blanks 48 are attached to the periphery of a rotating disk 50, and are machined to a desired shape by means of a diamond-tipped cutting tool 52. Typical shapes which can be produced by such a method of manufacturing are illustrated in the cross-sectional diagram of FIG. 11. Here, numeral 54 denotes the cross-section of the main hand portion of a hand which has been shaped to a triangular shape by machining with a diamond-tipped cutting tool, while numeral 56 indicates a hand having a rounded cross-section.

Figure 7:
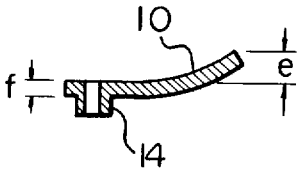
Fig. 7 PRIOR ART
FIG. 7 is a cross-sectional diagram illustrating bending distortion of a timepiece hand.

Such a method of manufacturing has a similar disadvantage to the electro-forming method first described, i.e. due to the mechanical machining performed on the top face of the timepiece hand as shown in FIG. 10, bending deformation is produced as indicated in FIG. 7, and the amplitude of this distortion increases as the thickness of the timepiece hand is reduced. Because of this, such a method is also not practicable for producing timepiece hands having a thickness of the order of less than 200 microns.

From the above, it can be understood that prior art methods used to produce small-size timepiece hands are not suited to mass-production of hands having a thickness of less than about 200 microns, due to bending distortion resulting from internal stresses induced by mechanical machining of the hand during its manufacture. In addition, the prior art electro-forming method of manufacture is complex and involves high production costs, so that hitherto such a method has only been used to produce the hands of very expensive, high-quality timepieces. The above problems are eliminated by the method of manufacturing of the present invention, as described in the following.

Figure 12:
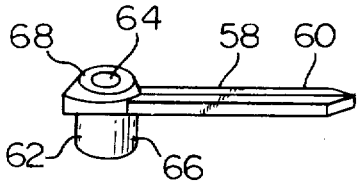
FIG. 12 is an oblique view of a timepiece hand produced by a manufacturing method according to the present invention.
Figure 13:
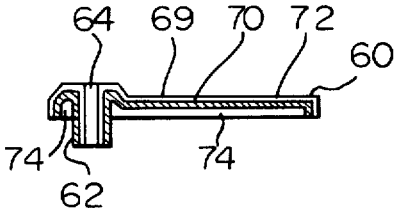
FIG. 13 is a cross-sectional diagram taken in the longitudinal direction of a timepiece hand produced according to the method of the present invention.
Figure 14:
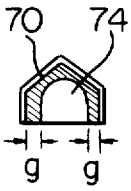
FIG. 14 is a cross-sectional diagram of the timepiece hand of FIG. 13, taken in the direction of the width.

FIG. 12 shows an example of a timepiece hand produced by a first embodiment of the method of the present invention. The timepiece hand 58 comprises a main hand portion 60, and a boss 62, with a bore 64 formed in the boss 62. Boss 62 comprises a lower portion 62 and an upper portion 68, each of precisely determined dimensions. Such a timepiece hand basically has an open hollow shell construction, as will be apparent from the cross-sectional diagrams of FIG. 13 (taken in the longitudinal direction) and FIG. 14 (taken in the width direction). In FIG. 13, numeral 69 denotes a finishing plating layer which may be applied to the completed hand, if desired. Layer 69 is formed over a layer of electrically conductive material 72, which is covered by a layer of hard nickel electro-forming 70. This hard nickel electro-forming layer 70 has a thickness of the order of 20 to 100 microns, and provides the structural strength of the timepiece hand, due to its curved shell configuration. The layers described above are curved to form an open cavity 74. Because of the shell shape of such a timepiece hand, a high degree of strength and rigidity is obtained, and bending distortion of the type shown in FIG. 7 is kept extremely low, even when the thickness of the hand is less than 200 microns. In addition, since the thickness of the electro-forming layers of the hand can be very small, as indicated in FIG. 14, the electro-forming process can be completed in a much shorter period of time than is required for a prior art electro-forming method which forms a hand having a cross-section such as is shown in FIG. 3, i.e. a solid cross-section. Thus, the present invention provides a method of manufacturing timepiece hands having a thickness of the order of 50 to 150 microns which is not only practicable but also has low manufacturing costs by comparison with prior art electro-forming methods.

Figure 15:
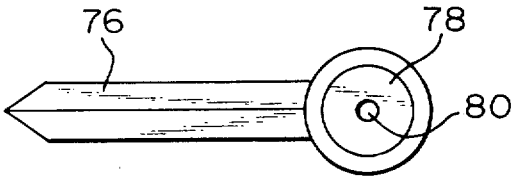
FIG. 15 is a plan view of a portion of a male metal mold used in forming a plastic matrix for use in the method of the present invention.
Figure 16A:
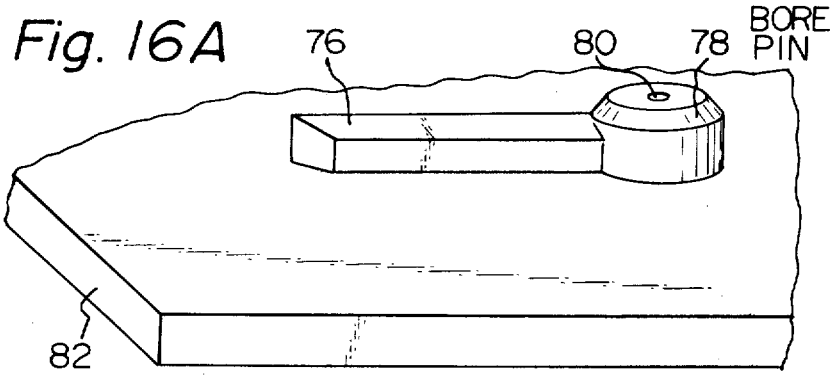
FIG. 16A is an oblique view of the male metal mold portion shown in FIG. 15.
Figure 16B:
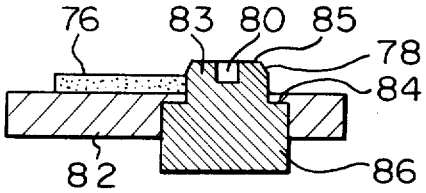
FIG. 16B is a cross-sectional diagram of the male metal mold portion shown in FIG. 16A.
Figure 17:
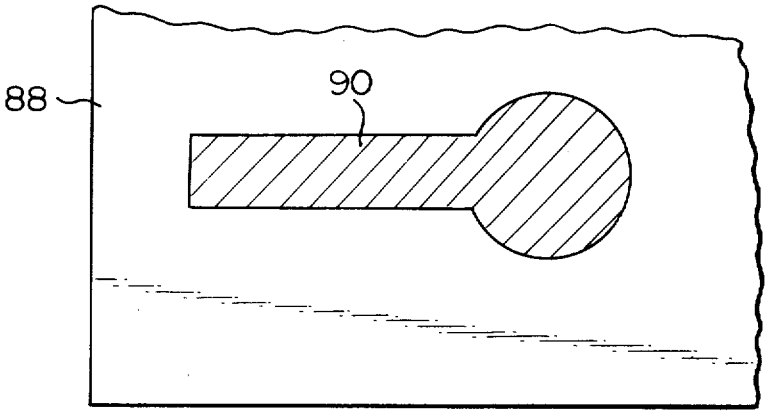
FIG. 17 is a plan view of a female metal mold portion used in conjunction with the male metal mold portions of FIGS. 15 and 16B, 16B in forming a plastic matrix.
Figure 18:
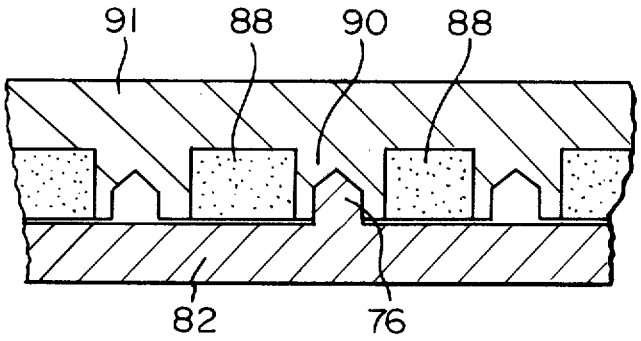
FIG. 18 is a cross-sectional diagram showing how a plastic matrix for the method of the present invention is produced using male and female molds in conjunction.

The method of manufacturing of the present invention comprises the steps of forming a plastic matrix by utilizing male and female metal plastic forming molds, performing metal plating upon the plastic matrix, performing grinding operations upon the plated layer and plastic matrix, and removal of the completed hand from the plastic matrix. FIG. 15 is a plan view of a male metal mold for forming a part of the plastic matrix corresponding to a single timepiece hand. In practice, a number (for example 5 to 10) of these male metal mold portions are assembled together on a baseplate, but for simplicity of description the following explanation will only describe the steps in manufacturing a single timepiece hand. In FIG. 15, numeral 76 denotes a portion of the male metal mold which corresponds in shape to the upper face of the main hand portion of the finished hand. A boss pin 78, of cylindrical shape, determines the shape of the boss of the finished hand, and an aperture 80 in boss pin 78 determines the shape of bore 64 of the finished hand. FIG. 16A shows an oblique view of such a male metal mold. The main hand portion 76 of the mold is integrally formed on a base portion 82, into which is fitted the boss pin 78. This configuration will be made more apparent from the cross-sectional diagram of FIG. 16B. As shown, boss pin 78 is formed with precisely shaped upper faces 83 and 85, which can be shaped by machining with a diamond-tipped cutting tool. The degree of protrusion of faces 83 and 85 above the mold base 82 is determined by a stepped portion 84 of boss pin 78. A lower protruding portion 86 of boss pin 78 is used to position the male metal mold on a mold baseplate, upon which the mold is arrayed with a number of others, as mentioned above. The male metal mold is preferably formed from free-cutting brass, for ease of machining, for example from a piece of this material which is 50 mm wide by 10 mm thick. To provide improved machining properties of the male metal mold when a diamond-tipped cutting tool is used for this machining, the mold should preferably be plated with copper to a thickness of 200 to 400 microns. Boss pin 78 is preferably formed of lead-free brass, to facilitate precise machining of the pin using a diamond-tipped cutting tool. FIG. 17 is a plan view of a female mold which is used in conjunction with the male mold shown in FIGS. 15 and 16A and 16B, to form a plastic matrix for electro-forming. The female mold comprises a metal plate having a number of apertures such as is denoted by numeral 90 cut out therefrom, with each of these apertures being slightly larger than the outer periphery of a metal mold, and being positioned to correspond with a set of male metal molds when the latter are assembled on a metal mold baseplate (not shown in the drawings). FIG. 18 is a simplified cross-sectional diagram to illustrate how a plastic matrix is formed by arranging a female mold above a set of male molds, and by pouring liquid plastic thereon to fill the regions between the male and female molds.

Figure 19:
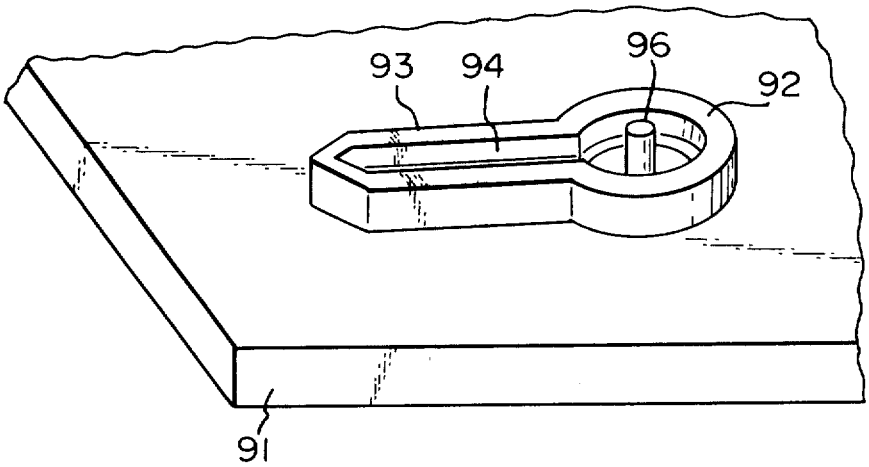
FIG. 19 is an oblique view of a portion of a completed plastic matrix, showing a timepiece hand forming portion.

A portion of the resultant plastic matrix, for forming a single timepiece hand, is shown in FIG. 19. This comprises a convex portion 94, whose lower and side faces determine the shape of the upper face of the finished timepiece hand and the hand boss, and a ridged, i.e. convex portion which surrounds this concave portion 94, comprising a convex portion 93 which surrounds the main hand portion of concave portion 94 and a circular convex portion 92 which surrounds the boss portion of concave portion 94, together with an upwardly protruding cylindrical portion 96 which will form the bore of the finished timepiece hand. These portions are formed upon the plastic matrix base 91. In an actual plastic matrix, a number of hand-forming portions such as that shown in FIG. 19 are arranged upon the upper face of plastic matrix base 91, so that a number (e.g. 5 to 10) of hands are formed simultaneously.

Figure 20:
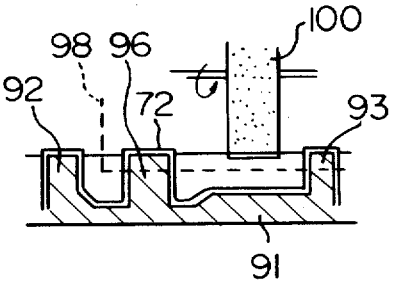
FIG. 20 is a cross-sectional diagram of a timepiece hand portion of a plastic matrix after deposition of an electrically conductive layer has been completed, and illustrating a primary grinding process performed thereon.
Figure 21:
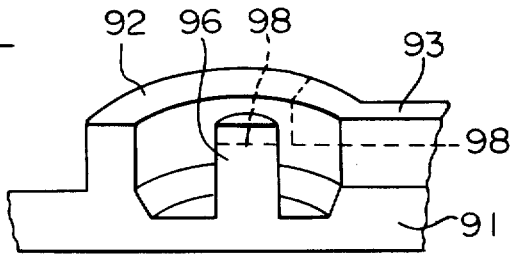
FIG. 21 is an expanded partial oblique view of a boss portion of a plastic matrix.

The next stage of the manufacturing method consists of forming a layer of electrically conductive material upon the upper surface of the plastic matrix, by a non-electrical coating method such as evaporative deposition. FIG. 20 is a cross-sectional diagram through a hand forming portion of the plastic matrix after deposition of the layer of electrically conductive material, denoted by numeral 72, has been completed, and also illustrates how a primary grinding process is performed at this stage. This primary grinding is carried out using a grinding wheel 100, and serves to remove parts of the layer of electrically conductive material which cover convex portions 93 and 96 of the plastic matrix, while leaving intact at least a part of the layer of electrically conductive material on convex portion 92. The grinding contour line is denoted by numeral 98. The portion of the layer of electrically conductive material 72 which is left intact at this stage serves to maintain an electrical path between the various surface areas to be treated in the subsequent stage of electro-forming, while removal of parts of the layer of electrically conductive material from areas in which electro-forming is not required serves both to reduce the amount of metal which is unnecessarily deposited and also substantially reduces the amount of secondary grinding working which must be carried out upon a layer of hard nickel electro-forming formed in the next stage. Thus, manufacturing costs are reduced both by a reduction of the metal used in the electro-forming process and by a reduction of the amount of machining which is required to form a hand, while in addition the reduction of the amount of mechanical machining also serves to reduce the possibility of bending distortion occurring in the completed timepiece hand, due to deformation stresses applied during machining. FIG. 21 is an oblique cross-sectional diagram of a part of the plastic matrix which serves to form the hand boss, illustrating how the primary grinding is performed.

In the next stage of the manufacturing method the layer of hard nickel electro-forming 70 is formed. During this electro-plating process, the lower face of plastic matrix base 91 is masked off. The composition of a suitable electrolyte for this hard nickel electro-forming step, and the electro-forming conditions, are preferably as detailed below.

Electrolyte Composition

Nickel sulfamate: 300 to 600 grams/liter
Nickel chloride: 10 to 20 grams/liter
Boracic acid: 30 to 50 grams/liter
Saccharin: 1 to 10 grams/liter
Laulic sodium sulfate: 0.3 to 5 grams/liter Electro-forming Conditions:

Current density: 3 to 30 A/dm$^2$
Electrolyte temperature: 30° to 40° C.
pH: 3.5 to 4.5
Agitation: Electrolyte spray method Laulic sodium sulfate is added to the electrolyte as a surfactant, to inhibit the production of hydrogen bubbles.

The thickness of the layer of hard nickel electro-forming thus formed is preferably from 20 to 100 microns. In the case of a timepiece hand having a thickness of the order of 100 microns, the thickness of the layer of hard nickel electro-forming should preferably be in the range from 60 to 80 microns. A time of from 10 to 60 minutes is sufficient to complete formation of the hard nickel electro-forming layer. This is very considerably less than is required by prior art electro-forming manufacturing methods for timepiece hands, for which a time of up to 20 hours may be necessary.

Figure 22:
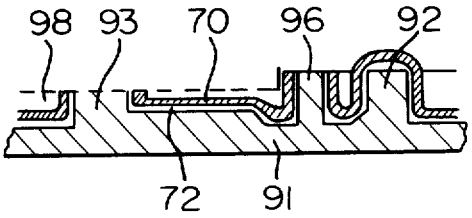
FIG. 22 is a cross-sectional diagram of a timepiece hand portion of a plastic matrix after electro-forming of a layer of hard nickel has been performed.

The reduced electro-forming time of the manufacturing method of the present invention is basically possible because of the strength and rigidity given by the curved shell configuration of the timepiece hand. After formation of the hard nickel electro-forming layer has been completed, the plastic matrix appears as shown in the cross-sectional diagram of FIG. 22. As shown, no layer of hard nickel electro-forming is formed on the surfaces of plastic matrix portions 93 and 96 which were exposed during the primary grinding process, and only the upper part of convex portion 92 has a nickel layer formed thereon.

Figure 23:
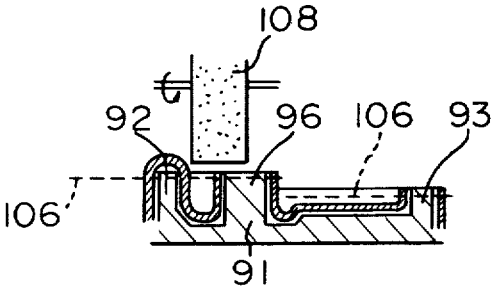
FIG. 23 is a cross-sectional diagram of the plastic matrix portion of FIG. 21, illustrating a secondary grinding process performed thereon.

A secondary grinding step is now performed, as illustrated in FIG. 23, whereby upper regions of the plastic matrix portions 92, 93 and 96, together with the layer of electrically conductive material and hard nickel electro-forming layer on portion 92. The grinding contour line is denoted by numeral 106.

Figure 24:
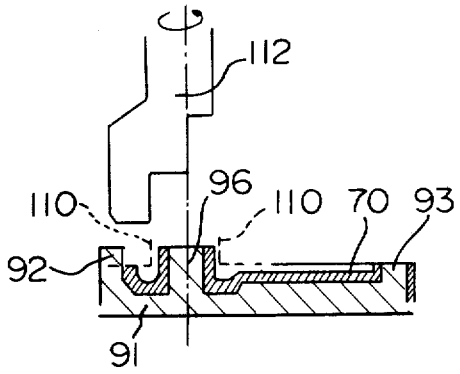
FIG. 24 is a cross-sectional diagram illustrating machining of the plastic matrix to shape the boss of the timepiece hand.

The boss portion 92 (corresponding to the lower face of the boss in the completed timepiece hand) is now machined to a desired shape, as shown in FIG. 24, using a rotating cutting tool 112. The cutting contour line is denoted by numeral 110.

During the secondary grinding and boss portion machining steps described above, it is necessary that the hard nickel electro-forming layer be firmly attached to the plastic matrix, otherwise the hard nickel electro-forming shell may peel off from the plastic matrix during the grinding or machining processes. To prevent this, processing should preferably be carried out in order to improve the adhesion of the layer of electrically conductive material 72 to the plastic matrix 91. This can be done by ageing the plastic matrix for a period of from 3 to 5 days at a temperature of 30° to 50° C., to ensure complete dryness of the plastic matrix, after deposition of the layer of electrically conductive material has been completed. Such processing will serve to eliminate any problems of poor adhesion of the layer of electrically conductive material, and hence the hard nickel electro-forming layer, to the plastic matrix.

Figure 25:
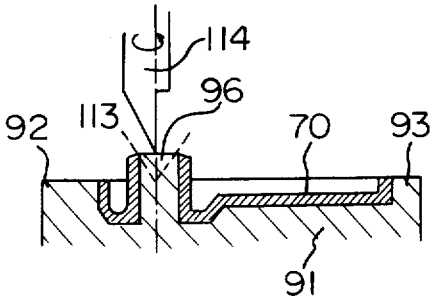
FIG. 25 is a cross-sectional diagram illustrating a step of chamfering the bore of the timepiece hand boss on the plastic matrix.

The next stage of manufacture is to chamfer the upper part of the boss bore, as illustrated in FIG. 25, which is a cross-sectional diagram also showing the effects of the machining step of FIG. 24. This work is performed using a chamfering bit, denoted by numeral 114.

Figure 26:
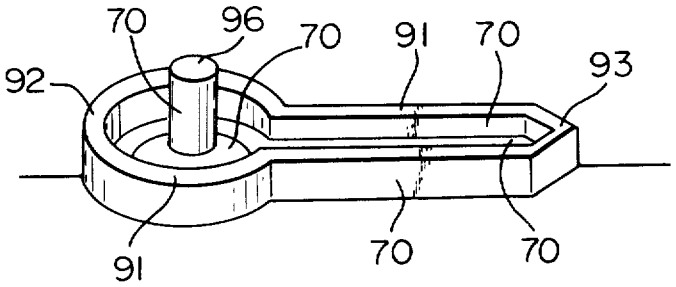
FIG. 26 is an oblique view of a timepiece hand portion of the plastic matrix, after all secondary grinding has been completed.

FIG. 26 is an oblique view showing the appearance of the timepiece hand forming portion of the plastic matrix after all of the machining and grinding operations described above have been completed. As a result of these operations, upper parts of the plastic matrix convex portions 92, 93 and 96 have become exposed from the metallic layers, as indicated by the hatched line regions. Remaining areas of the plastic matrix are covered by a layer of hard nickel electro-forming.

Figure 27:
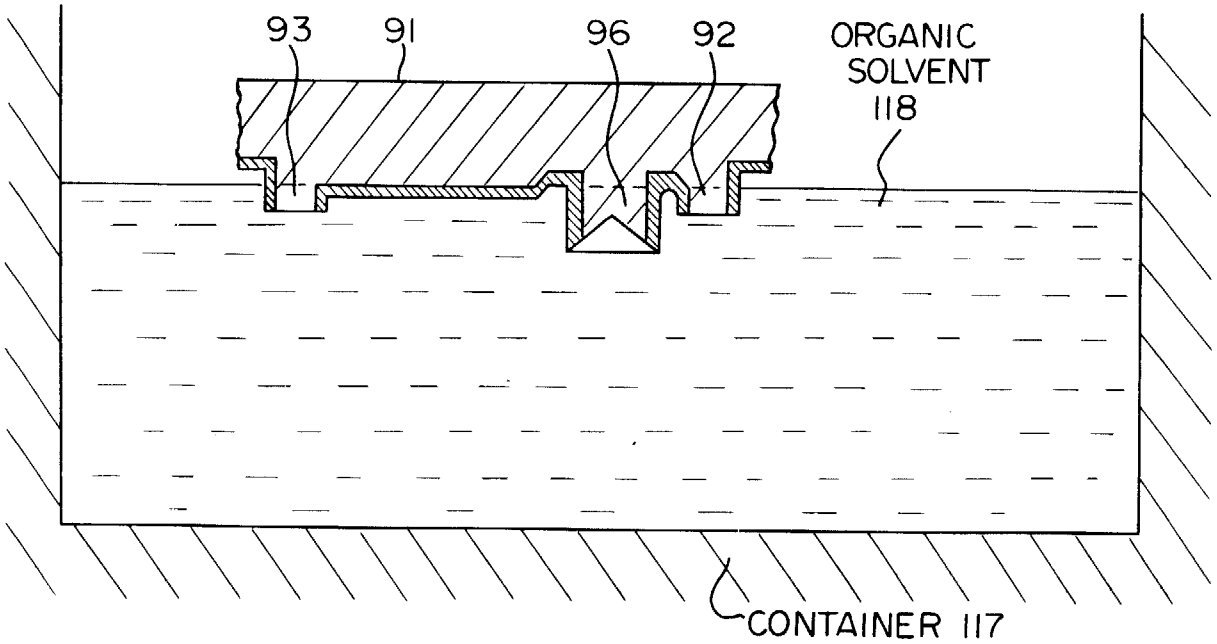
FIG. 27 is a cross-sectional view illustrating removal of a finished timepiece hand from the plastic matrix.

In the next step of the manufacturing method, the timepiece hands are removed from the plastic matrix by inverting the plastic matrix so that the base portion 91 is uppermost, and immersing only the convex portions 93, 92 and 96 in an organic solvent. This step is illustrated in FIG. 27, in which the plastic matrix is shown inverted over an organic solvent 118 held in a container 117, with exposed portions of the convex hand-forming regions of the plastic matrix, i.e. parts 92, 93 and 96, immersed in the solvent. The organic solvent 118 will now rapidly dissolve into the plastic of the exposed portions 92, 93 and 96, thereby separating the metallic shell of the timepiece hand from the plastic matrix. The completed timepiece hand will then drop to the bottom of solvent container 117, within a short period of time.

It is another feature of the manufacturing method of the present invention that the timepiece hand can now be cleaned while it is left in the organic solvent 118, by ultrasonic cleaning. Thus, no physical force is applied to the timepiece hand during the process of removal from the plastic matrix and the cleaning process.

If required, finishing electro-forming can now be performed on the completed timepiece hand.

A timepiece hand produced by the manufacturing method according to the present invention as described above will provide a high degree of attachment to the hand shaft of a timepiece when the hand is press-fitted thereon, even when the hand is extremely thin, and no problems such as bending distortion of the hand will occur. The manufacturing method of the present invention is therefore highly suitable for economical mass-production of very thin timepiece hands, with a low level of production costs.

Figure 28:
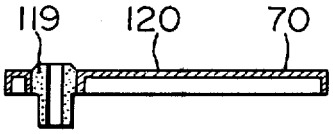
FIG. 28 is a cross-sectional diagram illustrating the construction of a timepiece hand manufactured according to a second embodiment of the method of the present invention.

In the embodiment of the manufacturing method of the present invention described above, the boss of the timepiece hand is formed integrally with the main hand portion. A second embodiment of the present invention will now be described in which the boss and the main hand portion are formed separately. In this second embodiment, the main hand portion is formed in the same way as the complete timepiece hand is formed by the first embodiment described in detail hereinabove. The boss of the hand can be machined separately, to as high a degree of precision as is necessary, and is then press-fitted or calk-fitted into an aperture left in the main hand portion. FIG. 28 is a cross-sectional diagram of a timepiece hand manufactured according to the second embodiment. The hand comprises a main hand portion 120 having the form of an open shell of hard nickel electro-forming 70 formed on an layer of electrically conductive material, manufactured as described for the first embodiment above. A boss 119, which is manufactured separately, is press-fitted into an aperture in the main hand portion 120.

Figure 29:
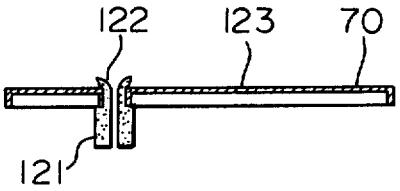
FIG. 29 is a cross-sectional diagram illustrating the construction of another type of timepiece hand manufactured according to the second embodiment of the method of the present invention.

Another example of a timepiece hand produced by the method of the second embodiment is shown in FIG. 29. Here, a calking portion 122 of the boss is expanded outward, so as to retain the boss 121 firmly within an aperture in the main hand portion 123, which is formed mainly of a shell of hard nickel electro-forming by the method of the first embodiment described hereinabove.

Figure 30:
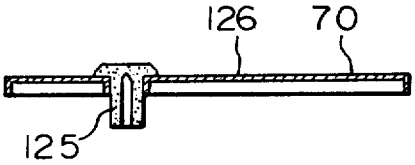
FIG. 30 is a cross-sectional diagram illustrating the construction of a timepiece hand having a blind bore in the boss thereof, manufactured according to the second embodiment of the method of the present invention.

A third example of a timepiece hand produced by the second embodiment is shown in the cross-sectional diagram of FIG. 30. This is "blind" seconds hand, i.e. a seconds hand having the top of the bore in the boss of the hand covered over. In assembling a timepiece using such a seconds hand, the boss 125, which is manufactured separately, can be press-fitted onto the seconds hand shaft of the timepiece by a simple and rapid operation. The construction of a seconds hand produced by the manufacturing method of the present invention is such that hand can be made extremely light in weight. This is very important for a small and thin seconds hand, to ensure good balance of the hand and to reduce the possibility of the hand becoming loosened from the seconds hand shaft of the timepiece and failing to rotate with that shaft.

From the above description, it can be understood that the manufacturing method of the present invention enables a timepiece hand to be manufactured which has a metal shell construction formed by an electro-forming process, whereby the timepiece hand can be made extremely thin and light, while also being strong and rigid. It can also be understood that the method of the present invention enables such timepiece hands to be produced with a low level of production costs, by a more rapid and simple process than has been possible with prior art methods. The reduction of production costs is brought about in part by a reduction of the amount of material unnecessarily consumed in the manufacturing process, for example by reducing the amount of metal deposited in an electro-forming process by removing certain portions of a layer of electrically conductive material prior to that electro-forming process, and by immersing only certain convex portions of a plastic matrix in an organic solvent to thereby reduce the amount of solvent consumed in the process of removing finished timepiece hands from that plastic matrix. In addition, as described hereinabove, the manufacturing method is such that a minimum of mechanical deformation is applied to the timepiece hands before and during removal of the hands from the electro-forming matrix, so that bending distortion of the hands is almost entirely eliminated, even for the case of very thin hands.

From the above description, it will be apparent that the objectives set forth for the present invention are effectively attained. Since various changes and modifications to the above methods may be made without departing from the spirit and scope of the present invention, it is intended that all matter contained in the above description or shown in the accompanying drawings shall be interpreted as illustrative, and not in a limiting sense. The appended claims are intended to cover all of the generic and specific features of the invention described herein.

What is claimed is:

1. A method of forming a timepiece hand, comprising the steps of:

preparing a plastic matrix having a concave portion formed therein, with at least a part of said concave portion being formed into a shape which corresponds to that of a surface of said timepiece hand, said plastic matrix further having a convex portion formed to peripherally surround said concave portion;

forming a layer of electrically conductive material over said concave and convex portions of said plastic matrix;

partially removing said layer of electrically conductive material by grinding an uppermost area of said peripheral convex portion of said plastic matrix;

performing electro-forming to form a layer of a hard metal over the remaining areas of said layer of electrically conductive material;

performing grinding of an uppermost area of said peripheral convex portion of said plastic matrix to remove said layer of electrically conductive material and layer of electro-formed hard metal therefrom, whereby an uppermost area of said peripheral convex portion of said plastic matrix forming a continuous path around said concave portion of said plastic matrix which is completely exposed from said layer of electrically conductive material and said electro-formed layer of hard metal; and immersing said peripheral convex portion of said plastic matrix in an organic solvent, to thereby dissolve and remove portions of said plastic matrix around said concave region thereof, whereby a timepiece hand comprising said layer of electrically conductive material and said electro-forming layer of hard metal formed on said concave portion becomes separated from said plastic matrix.

2. A method of forming a timepiece hand according to claim 1, in which said electro-formed layer of hard metal comprises a layer of nickel.

3. A method of forming a timepiece hand according to claim 1, in which a part of said concave portion of said plastic matrix is shaped such as to form a boss of said timepiece hand during said steps of depositing a layer of electrically conductive material and electro-forming a layer of hard metal.

4. A method of forming a timepiece hand according to claim 1, wherein said step of grinding an uppermost area of said peripheral convex portion of said plastic matrix to remove said layer of electrically conductive material and layer of electro-formed hard metal further involves shaping of said peripheral convex portion of said plastic matrix such as to produce a desired shape of a lower part of said timepiece hand.

5. A method of forming a timepiece hand according to claim 1, in which said step of preparing a plastic matrix further comprises the preparation of a male metal mold having a convex portion formed thereon with an upper part of said convex portion being formed to the desired shape of a timepiece hand, and the preparation of a female metal mold having an aperture cut therethrough, with the periphery of said aperture being greater than that of said convex portion of said male metal mold, and arranging said female mold upon said male mold such that said convex portion of said male metal mold is disposed within said aperture in said female metal mold but separated from the periphery thereof, then applying a plastic material to cover said male and female metal molds and to fill spaces formed therebetween, to thereby form said plastic matrix.

* * * * *